US005386789A

United States Patent [19]

Futamura et al.

[11] Patent Number: 5,386,789

[45] Date of Patent: Feb. 7, 1995

[54] EMBROIDERY DATA PRODUCING APPARATUS FOR CONTROLLING A SEWING MACHINE

[75] Inventors: Masao Futamura, Nagoya; Mitsuyasu Kyuno, Aichi; Yukiyoshi Muto, Nagoya; Masahiro Mizuno, Kasugai, all of Japan

[73] Assignee: Brother Kogyo Kabushiki Kaisha, Aichi, Japan

[21] Appl. No.: 254,790

[22] Filed: Jun. 6, 1994

[30] Foreign Application Priority Data

Jun. 14, 1993 [JP] Japan ..... 5-141847

[51] Int. Cl.[6] ..... D05B 21/00

[52] U.S. Cl. ..... 112/121.12; 112/103; 112/262.3; 112/266.1; 364/470

[58] Field of Search ..... 112/121.12, 121.11, 112/103, 262.3, 266.1, 78, 2, 453, 457; 364/470

[56] References Cited

U.S. PATENT DOCUMENTS 5,189,623 2/1992 Komuro et al. ..... 112/121.12 X
5,299,514 4/1994 Hayakawa et al. ..... 112/121.12
5,313,896 5/1994 Hashiride ..... 112/121.12
5,335,182 8/1994 Asano ..... 112/121.12 X

*Primary Examiner*—Peter Nerbun
*Attorney, Agent, or Firm*—Oliff & Berridge

[57] ABSTRACT

An apparatus for producing embroidery data to control a sewing machine to form an embroidery on a work sheet, including a dividing device for dividing, based on image data representing a color image, the color image into a plurality of color areas each of which has a corresponding one of a plurality of different colors, and producing a plurality of sets of color-area data each of which represents a corresponding one of the color areas, a color-area specifying device which is operable by an operator for specifying one of the color areas as an embroidery-free area, and a producing device for producing, based on the sets of color-area data, the embroidery data to control the sewing machine to embroider the color areas except for the embroidery-free area. An apparatus for producing embroidery data, including a dividing device for dividing, based on image data representing a color image, the color image into a plurality of color areas each of which has a corresponding one of a plurality of different colors, and producing a plurality of sets of color-area data each of which represents a corresponding one of the color areas, an identifying device for identifying one of the color areas as an embroidery-free area, and a producing device for producing, based on the sets of color-area data, the embroidery data to control a sewing machine to embroider the color areas except for the embroidery-free area.

46 Claims, 9 Drawing Sheets

EMBROIDERY DATA PRODUCING APPARATUS FOR CONTROLLING A SEWING MACHINE

BACKGROUND OF THE INVENTION

1. Field of the Invention

The present invention relates to an apparatus for producing embroidery data to control a sewing machine to form an embroidery on a work sheet.

2. Related Art Statement

There is known an embroidery sewing machine which automatically forms an embroidery on a work sheet such as a work cloth. Embroidery data are used to control the sewing machine to form the embroidery on the work sheet. The embroidery data include, e.g., sets of stitch-position data representative of stitch positions on the outline of a closed area to be filled with stitches to provide the embroidery, i.e., each stitch position corresponding to amounts of movement of the work sheet relative to the sewing needle in the X and Y directions pre-determined for the sewing machine. Embroidery data may otherwise include sets of block data representative of respective outlines of polygonal blocks as divisions of a closed area. U.S. Pat. No. 5,189,623 assigned to the Assignee of the present application discloses an embroidery data producing apparatus which automatically produces such embroidery data.

The above-identified embroidery data producing apparatus may be constituted by (a) a personal computer (PC), (b) an image scanner, (c) a keyboard, (d) a hard disk drive (HDD), and (e) a cathode ray tube (CRT) display. The elements (b) to (e) are connected to the PC. The conventional apparatus produces embroidery data based on a white-black original image, in the following manner:

First, the image scanner is operated to read in the original image from an original (e.g., black image drawn on a white sheet of paper), so that the PC produces image data representing the original image. Next, the PC produces one or more sets of outline data representative of the outline or outlines of one or more closed areas constituting the original image. Furthermore, the PC produces sets of block data representative of the outlines of an array of polygonal blocks such as quadrangles and/or triangles which extend in an embroidering direction, i.e., X and Y coordinates of the positions of the vertices of the quadrangular or triangular blocks, and it finally produces embroidery data, e.g., sets of stitch-position data representative of stitch positions located on the outline of each of the blocks where satin stitches or seed stitches, for example, are formed to fill the inside of each block.

There have been increasing demands for diversified and/or sophisticated embroideries. With this tendency, there have been provided embroidery sewing machines having improved performances, e.g., function of producing a multiple-color and/or elaborate embroidery. For even a home sewing machine, there have been demands to improve its performance so that the sewing machine has not only the function of forming an embroidery according to pre-stored embroidery data but also the function of forming an embroidery corresponding to an original image desired by an individual user.

For forming a multiple-color embroidery with different color threads, it is necessary to divide an original image into a plurality of "color-different" areas to be embroidered with the different color threads and produce a set of embroidery data for each of the color-different areas. However, the conventional embroidery data producing apparatus obtains only such image data representing the shape of an original image, e.g., "black" portions to be embroidered and "white" portions not to be embroidered. Thus, the embroidery data produced only represent which portion is to be embroidered and which portion is not to be embroidered.

The conventional apparatus requires an operator or user to divide a color original image into a plurality of color-different areas, prepare a plurality of secondary originals bearing the color-different areas, respectively, and produce a set of embroidery data for each of the color different areas from a corresponding one of the secondary originals. This work is very cumbersome and time-consuming. Additionally, in this method, the peripheral portions of the color-different areas may overlap each other, so that some portion may be embroidered with two or more different color threads and some portion may not be embroidered with any color threads.

Furthermore, if a color image scanner is used to obtain as image data a chromatic original image from an original and the image data obtained are plotted in the color space so as to divide the original image into a plurality of color-different areas and thereby produce a set of embroidery data for each of the color-different areas, a set of embroidery data is adversely prepared for the background area of the original image in the case where the color image is drawn on a white sheet of paper. Usually, however, the user does not wish to embroider the white background area.

SUMMARY OF THE INVENTION

It is therefore an object of the present invention to provide an apparatus and a process for easily producing embroidery data to control a sewing machine to form a multiple-color embroidery.

The above object has been achieved by the present invention. According to a first aspect of the present invention, there is provided an apparatus for producing embroidery data to control a sewing machine to form an embroidery on a work sheet, the apparatus comprising dividing means for dividing, based on image data representing a color image, the color image into a plurality of color areas each of which has a corresponding one of a plurality of different colors, and producing a plurality of sets of color-area data each of which represents a corresponding one of the color areas; a color-area specifying device which is operable by an operator for specifying one of the color areas as an embroidery-free area; and producing means for producing, based on the sets of color-area data, the embroidery data to control the sewing machine to embroider the color areas except for the embroidery-free area specified by the specifying device.

In the embroidery data producing apparatus in accordance with the first aspect of the invention, the producing means automatically produces, based on the sets of color-area data, the embroidery data for embroidering the color areas having the different colors. In addition, the color-area specifying device is operated by an operator for specifying one of the color areas as an embroidery-free area. The specifying device may be operated for specifying the background area of the color image as an embroidery-free area. However, the specifying device may be operated for specifying any one of the color areas as an embroidery-free area. The producing means produces the embroidery data for the color areas except for the embroidery-free area. Thus, the present apparatus produces excellent embroidery data without needing much work of the operator.

According to a preferred feature of the first aspect of the invention, the dividing means comprises means for dividing a chromatic image as the color image, into the color areas having different chromatic colors, respectively. The chromatic image may be constituted by, e.g., a red, a blue, a yellow, and a white area. Alternatively, the dividing means may comprise means for dividing an achromatic image as the color image, into the color areas having different achromatic colors, respectively. The achromatic image may be constituted by, e.g., a black, a gray, and a white area.

According to another feature of the first aspect of the invention, the apparatus further comprises a memory which stores the image data comprising a number of sets of picture-element data each set of which represents a color characteristic of a corresponding one of a number of picture elements of the color image. The color characteristic may be a scholar quantity such as a hue or a brightness, or a vector quantity such as reflectances of red, green, and blue lights, or spectral tristimulus values. Each set of picture-element data may be a set of eight-bit data representing a value from 0 to 255 corresponding to the hue of a corresponding one picture element. The dividing means may divide the color image into the color areas having the different colors, based on the sets of bit data representing the values corresponding to the respective hues of the picture elements of the color image.

According to yet another feature of the first aspect of the invention, the apparatus further comprises a modifying device which modifies the embroidery-free area specified by the color-area specifying device. The modifying device may comprises means for dividing the embroidery-free area into a plurality of separate portions isolated from each other; and an embroidering-portion specifying device which is operable by an operator for specifying one of the separate portions as an embroidering portion, the producing means producing the embroidery data including data for the embroidering portion. In this case, the operator can determine, once more, whether or not to embroider each of the separate portions belonging to the embroidery-free area selected by the operator. Thus, the apparatus produces more excellent embroidery data for forming an elaborate multiple-color embroidery.

According to a second aspect of the present invention, there is provided an apparatus for producing embroidery data to control a sewing machine to form an embroidery on a work sheet, the apparatus comprising dividing means for dividing, based on image data representing a color image, the color image into a plurality of color areas each of which has a corresponding one of a plurality of different colors, and producing a plurality of sets of color-area data each of which represents a corresponding one of the color areas, identifying means for identifying one of the color areas as an embroidery-free area, and producing means for producing, based on the sets of color-area data, the embroidery data to control the sewing machine to embroider the color areas except for the embroidery-free area identified by the identifying means.

In the embroidery data producing apparatus in accordance with the second aspect of the invention, the producing means automatically produces, based on the sets of color-area data, the embroidery data for embroidering the color areas having the different colors. In addition, the identifying means automatically identifies one of the color areas as an embroidery-free area. The identifying means may identify the background area of the color image as the embroidery-free area. The producing means produces the embroidery data for the color areas except for the embroidery-free area, e.g., background area. Thus, the present apparatus produces excellent embroidery data without needing much work of the operator.

According to a preferred feature of the second aspect of the invention, the apparatus further comprises a modifying device which modifies the embroidery-free area identified by the identifying means. The modifying device comprises means for dividing the embroidery-free area into a plurality of separate portions isolated from each other; and embroidering-portion identifying means for identifying one of the separate portions as an embroidering portion, the producing means producing the embroidery data including data for the embroidering portion. In this case, the apparatus determines, once more, whether or not to embroider each of the separate portions belonging to the embroidery-free area. Thus, the present apparatus produces more excellent embroidery data for forming an elaborate multiple-color embroidery.

According to a third aspect of the present invention, there is provided an apparatus for producing embroidery data to control a sewing machine to form an embroidery on a work sheet, the apparatus comprising dividing means for dividing, based on image data representing a color image, the color image into a plurality of color areas each of which has a corresponding one of a plurality of different colors, and producing a plurality of sets of color-area data each of which represents a corresponding one of the color areas; background-area identifying means for identifying one of the color areas as a background area of the color image; and producing means for producing, based on the sets of color-area data, the embroidery data to control the sewing machine to embroider the color areas except for the background area identified by the identifying means.

The embroidery data producing apparatus in accordance with the third aspect of the invention enjoys the same advantages as those of the apparatus in accordance with the second aspect of the invention. Since the background area of an original color image does not need embroidering, the present apparatus comprises the background-area identifying means for identifying one of the color areas as the background area of the color image, and the producing means for producing the embroidery data for the color areas except for the background area. Thus, the present apparatus identifies the background area of the color area as an embroidery-free area not to be embroidered, i.e., filled with stitches.

According to a fourth aspect of the present invention, there is provided a process of producing embroidery data to control a sewing machine to form an embroidery on a work sheet, the process comprising the steps of dividing, based on image data representing a color image, the color image into a plurality of color areas each of which has a corresponding one of a plurality of different colors, and producing a plurality of sets of color-area data each of which represents a corresponding one of the color areas; specifying one of the color areas as an embroidery-free area by operating a color-area specifying device; and producing, based on the sets of color-area data, the embroidery data to control the sewing machine to embroider the color areas except for the embroidery-free area.

The embroidery data producing process in accordance with the fourth aspect of the invention enjoys the same advantages as those of the apparatus in accordance with the first aspect of the invention.

According to a fifth aspect of the present invention, there is provided a process of producing embroidery data to control a sewing machine to form an embroidery on a work sheet, the process comprising the steps of dividing, based on image data representing a color image, the color image into a plurality of color areas each of which has a corresponding one of a plurality of different colors, and producing a plurality of sets of color-area data each of which represents a corresponding one of the color areas; identifying one of the color areas as an embroidery-free area; and producing, based on the sets of color-area data, the embroidery data to control the sewing machine to embroider the color areas except for the embroidery-free area.

The embroidery data producing process in accordance with the fifth aspect of the invention enjoys the same advantages as those of the apparatus in accordance with the second aspect of the invention.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings in which.

DETAILED DESCRIPTION OF THE PREFERRED EMBODIMENTS

Figure 3:
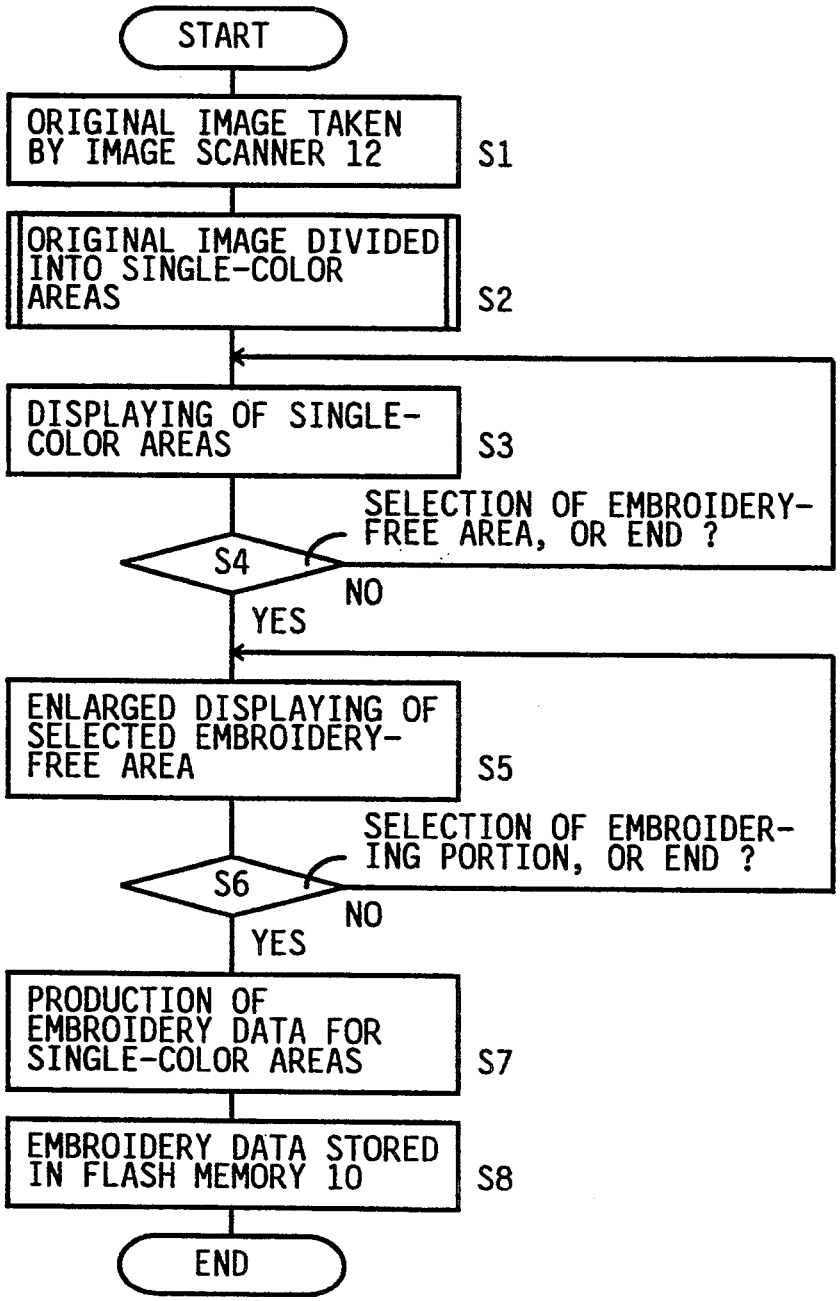
FIG. 3 is a flow chart representing the embroidery data production control program used by the apparatus of FIG. 1.
Figure 4:
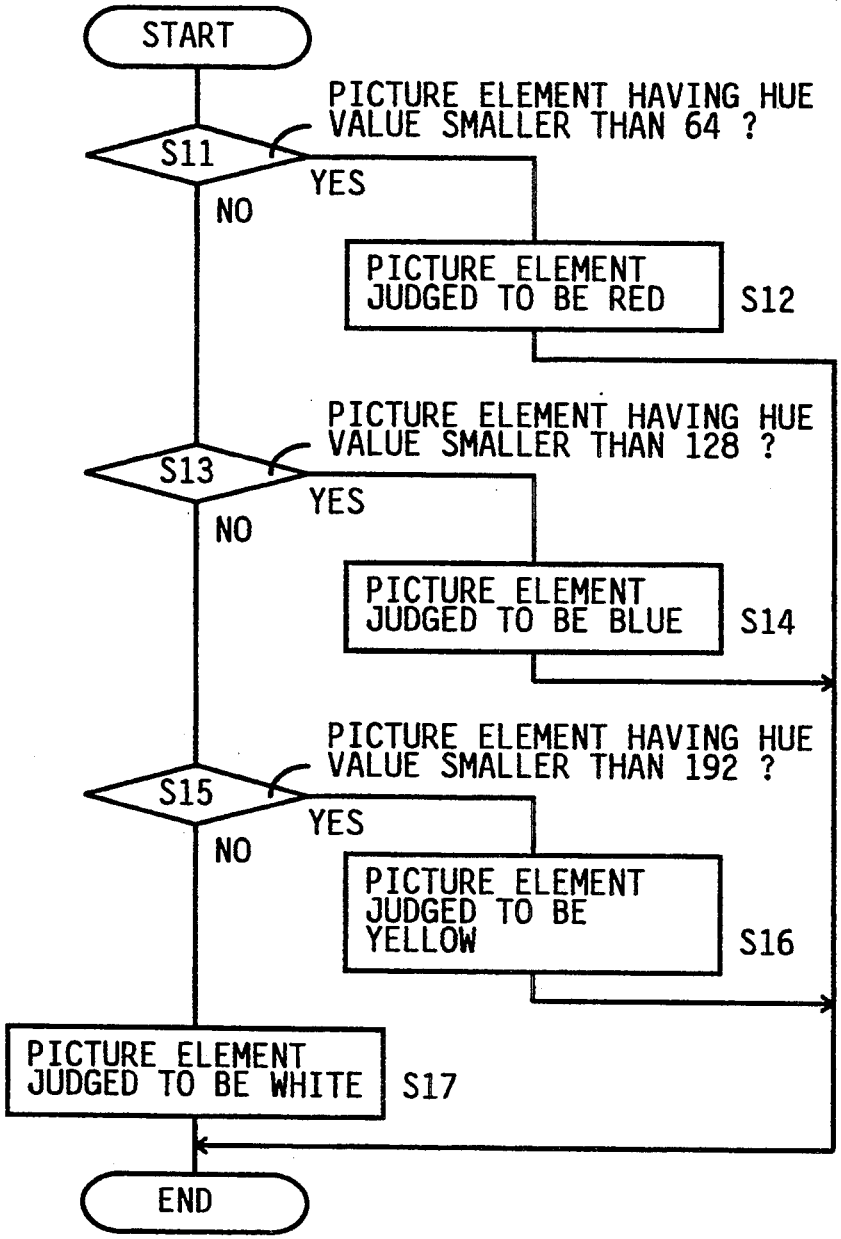
FIG. 4 is a flow chart representing the subroutine carried out at Step S2 of FIG. 3.
Figure 5:
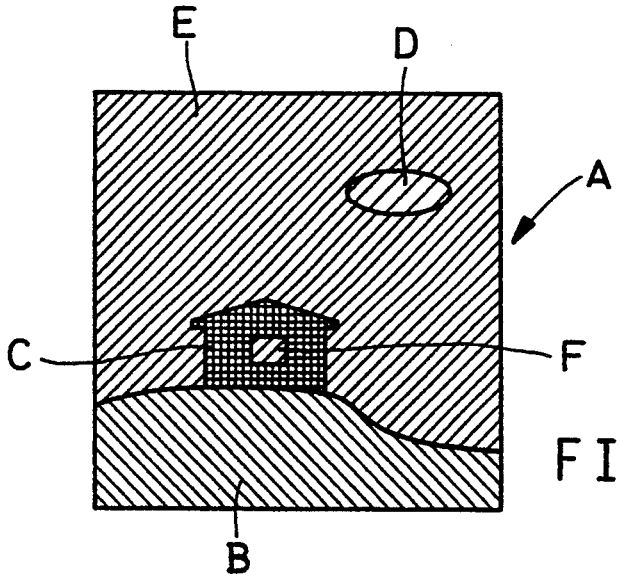
FIG. 5 is a view of a color image of an original.

There will be described an embroidery data producing apparatus 1 as a first embodiment of the present invention, by reference to FIGS. 1 through 7. The following description relates to the operation of the apparatus 1 for producing embroidery data for embroidering, e.g., an original color image, A, shown in FIG. 5 wherein a house, C, having a window, F, stands on a hill, B, with a cloud, D, in a sky E. In FIG. 5, the hill B, house C, cloud D, and the sky and window E, F are indicated by different hatchings, respectively. The color image A, i.e., original is obtained by painting the hill B, house C, and cloud D in different colors on a white sheet. Thus, the sky and window E, F have the white color, and provide the background area of the color image A.

Figure 1:
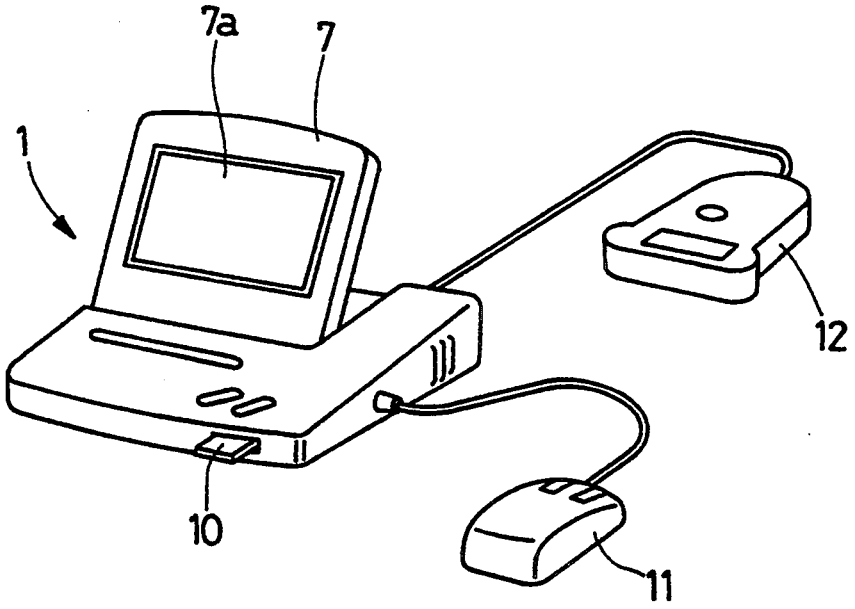
FIG. 1 is a perspective view of an embroidery data producing apparatus as a first embodiment of the present invention.
Figure 10:
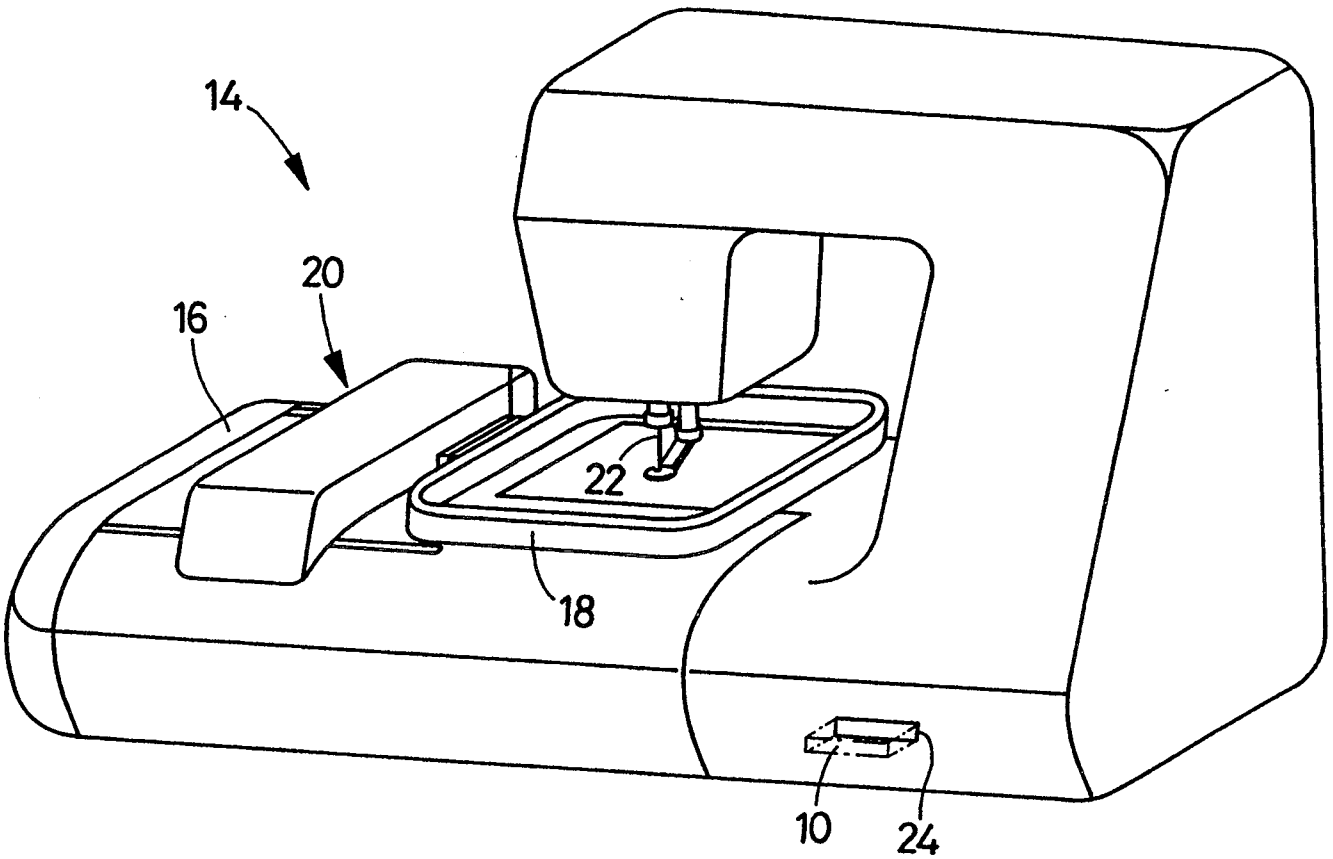
FIG. 10 is a view of a home sewing machine which forms an embroidery according to the embroidery data produced by the apparatus of the present invention.

FIG. 10 shows a home or domestic embroidery sewing machine 14 which automatically embroiders the color image, i.e., embroidery A on a work sheet (not shown) such as a cloth, fabric, or leather according to the embroidery data produced by the apparatus of FIG. 1. The sewing machine 14 includes a machine bed 16; an embroidery frame 18 for supporting the work sheet; an X–Y feed mechanism 20 for moving the embroidery frame 18 to a desired position in a horizontal plane defined by an X–Y coordinate system predetermined for the sewing machine 14; a sewing needle 22 for conveying a needle thread (not shown); and a loop catcher (not shown) provided in the machine bed 16 for catching a loop of a needle thread conveyed by the sewing needle 22; and a drive mechanism (not shown) for reciprocating the sewing needle 22 and rotating the loop catcher in synchronism with each other; and a control device (not shown) which may be constituted by a microcomputer and which operates for controlling the feed and drive mechanisms to automatically form the embroidery A on the work sheet according to the embroidery data produced by the apparatus 1 of FIG. 1.

The embroidery data produced by the apparatus 1 of FIG. 1 may include sets of stitch-position data (e.g., X and Y coordinate data) which represent respective stitch positions where the sewing needle 22 penetrates the work sheet to form corresponding stitches. Each set of stitch-position data represents respective amounts of movement of the work sheet or embroidery frame 18 along the X and Y axes to form a corresponding stitch. Alternatively, the embroidery data may include sets of block data each of which represents the outline of a corresponding one of polygonal blocks which cooperate with each other to define the color image. In the latter case, the control device of the sewing machine 14 may be programmed to produce sets of stitch-position data based on the sets of block data and a set of stitch-density data representative of a number of stitches to be formed in unit length or in each block.

As shown in FIG. 10, the sewing machine 14 has a data reading device 24 which reads embroidery data from a flash-memory card 10 (flash memory is an EEPROM (electrically erasable and programmable read only memory)). The apparatus 1 produces embroidery data and stores the embroidery data in the flash memory 10, as described later. Alternatively, the apparatus 1 may be connected to the sewing machine 14, so that the embroidery data produced by the apparatus 1 may directly be transferred to the control device of the sewing machine 14. Otherwise, the apparatus 1 may be incorporated into the sewing machine 14 of FIG. 10.

Figure 2:
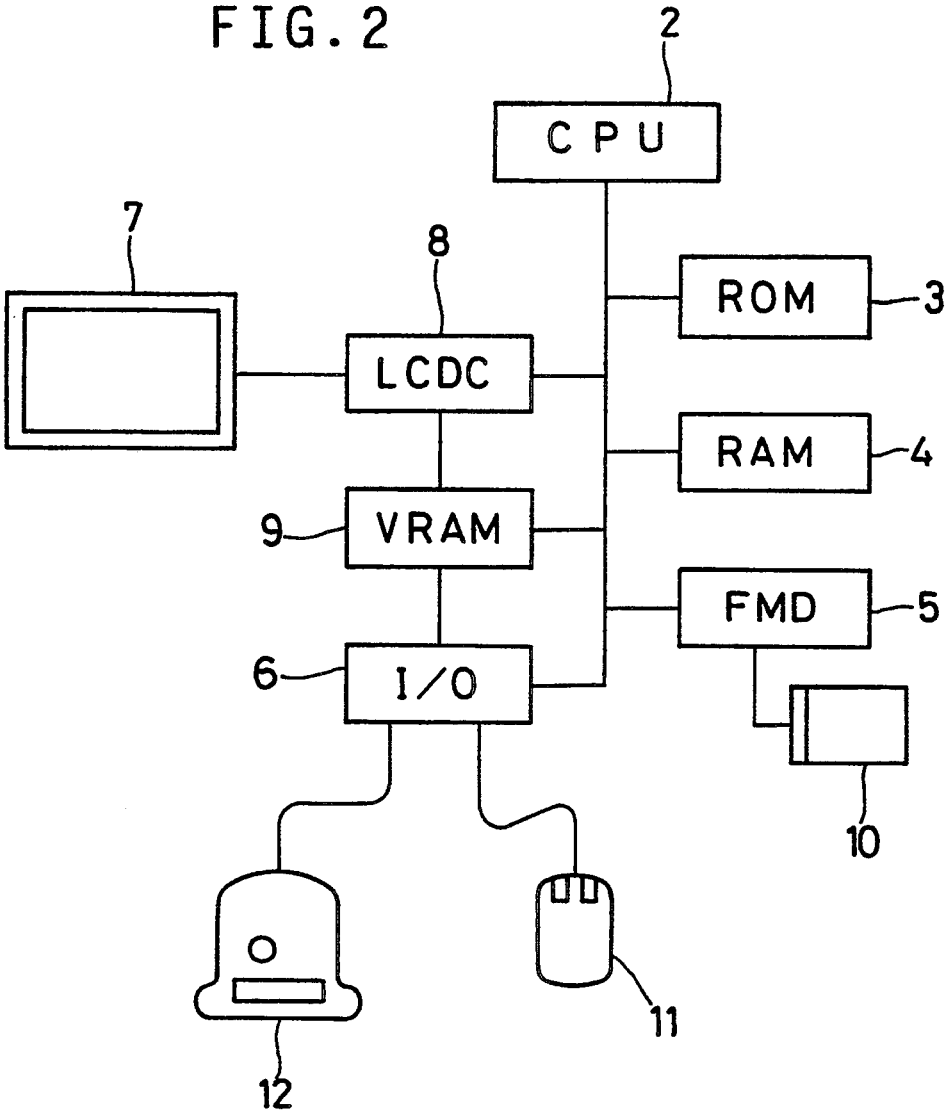
FIG. 2 is a diagrammatic view of the electronic arrangement of the apparatus of FIG. 1.

Next, the arrangement of the data producing apparatus 1 will be described in detail by reference to FIGS. 1 and 2. The apparatus 1 is essentially constituted by a microcomputer including a central processing unit (CPU) 2, a read only memory (ROM) 3, a random access memory (RAM) 4, a flash-memory data writing device (FMD) 5, and an input and output (I/O) interface 6 which are connected to one another via bus. The FMD 5 holds the flash-memory card 10 as an external memory. The flash-memory card 10 can be removed from the apparatus of FIG. 1 so as to be inserted into the flash-memory reading device 24 of the sewing machine 14.

The apparatus 1 additionally includes, on the top thereof, a liquid crystal display (LCD) 7 having a screen *7a* for providing a color representation of the original image A taken from the original. The LCD 7 is controlled by a display control device (LCDC) 8. A display-data memory device 9 such as a video RAM is connected to the LCDC 8. Additionally, the apparatus 1 includes a mouse 11 which is operable by an operator or user for moving a cursor (not shown) on the screen *7a* of the LCD display 7; and an image scanner 12 for picking up the original image A from the original. The LCD display 7, and mouse 11, image scanner 12 are connected to the microcomputer via the I/O interface 6.

In the present embodiment, the image scanner 12 is constituted by a hand-operable color image scanner capable of taking a chromatic color image. With the upper portion of the scanner 12 being held with the palm of the operator, the lower portion (i.e., reading head) of the scanner 12 is rolled over the original. With a button (not shown) of the scanner 12 being pushed by the operator, the scanner 12 is moved slowly in one direction over the original image A. Consequently, the original image A is obtained as raster-type digital image data, i.e., a number of sets of picture-element data corresponding to a number of picture-elements of the original image A. Each set of picture-element data is constituted by a set of eight-bit data representing a value from 0 to 255 corresponding to a hue of a picture element. Thus, the image scanner 12 serves as an image pick-up device which picks up a color image from an original and produces image data representing the color image. The thus obtained image data are temporarily stored in the RAM 4.

The embroidery data producing apparatus 1 is programmed to automatically produce embroidery data based on the original color image A. For producing the embroidery data, first, the image scanner 12 is operated to read as image data the color image A from the original, subsequently divides the color image A into a plurality of single-color areas having different colors from each other, and then produces a batch of embroidery data for each of the single-color areas.

Figure 6:
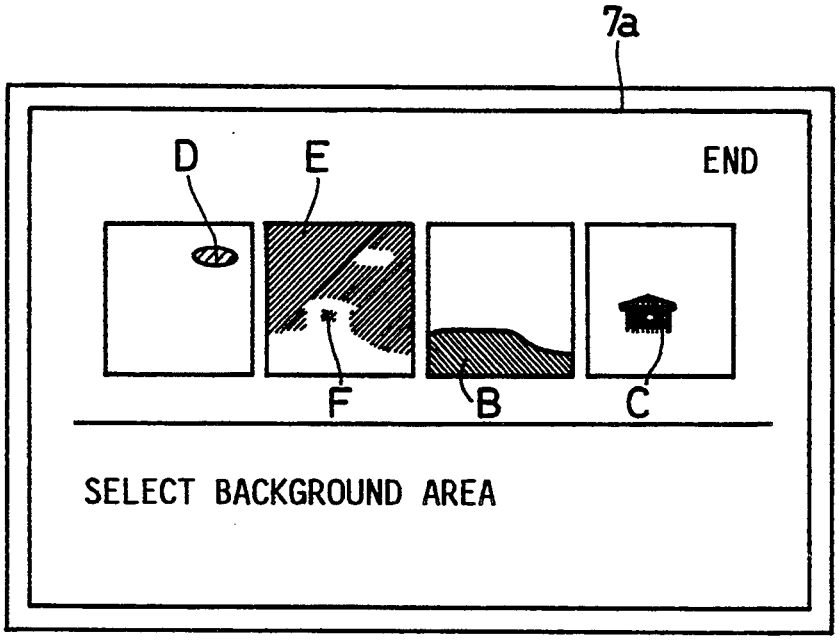
FIG. 6 is a view of a screen of a CRT display of the apparatus of FIG. 1, the screen displaying color-different areas of the original image so that an operator or user can select one of the color-different areas as an embroidery-free area.

As described in detail later, the apparatus 1 displays respective images of the single-color areas on the LCD 7 as shown in FIG. 6, and waits for the operator's operation to specify, using the mouse 11 (and the cursor movable on the screen *7a*), one of the single-color areas as an embroidery-free area which may be the background area of the color image A as indicated in FIG. 6. In the case where an embroidery-free area is specified by the operator, the apparatus 1 produces embroidery data for the single-color areas of the color image A except for the specified embroidery-free area. In the present embodiment, the CPU 2, ROM 3, and RAM 4 serve as dividing means for dividing the color image into color areas having different colors, and the LCD 7, LCDC 8, VRAM 9, and mouse 11 serve as a color-area specifying device operable for specifying one of the color areas as an embroider-free area not to be embroidered. The present apparatus 1 may be programmed to simultaneously specify two or more of the color areas as embroidery-free areas.

In the case where an embroidery-free single-color area is specified by the operator through operation of the cursor and mouse 11, the apparatus 1 displays the image of the specified embroidery-free area on the LCD 7, and waits for the operator's operation to specify, using the cursor and mouse 11, one of separate portions of the embroidery-free area. In the case where a single-color area has two or more separate portions isolated from each other, like the sky and window E, F of the color image A, the apparatus 1 divides the single-color area into the separate portions in a known process. The apparatus 1 has the function of preparing the embroidery data by excluding the specified separate portion from the selected embroidery-free area, i.e., preparing the embroidery data including data for the specified separate portion. Thus, the LCD 7, LCDC 8, VRAM 9, and mouse 11 serve as an embroidery-free area modifying device.

There will be described the operation of the embroidery data producing apparatus 1, by reference to the flow charts of FIGS. 3 and 4. The flow chart of FIG. 3 represents the embroidery data production control program employed by the apparatus 1, and the flow chart of FIG. 4 represents the steps carried out in the subroutine of Step S2 of FIG. 3. The following description relates to the operation of the apparatus 1 for producing embroidery data for the original color image A shown in FIG. 5.

First, at Step S1, the image scanner 12 is operated to pick up the color image A from the original, so that the CPU 2 produces image data representing the color image A. As described above, the color image A has a plurality of single-color areas having different colors, respectively. The image data include a number of sets of eight-bit hue data representing the hue of a corresponding one of the picture elements of the color image A taken by the image scanner 12. Based on the image data, the CPU 2 commands the LCDC 8 to display the color image A on the screen *7a*.

Subsequently, at Step S2, the CPU 2 divides, based on the image data, the color image A into a plurality of single-color areas having different colors. To this end, every set of eight-bit hue data of the image data is checked according to the flow chart of FIG. 4. At Step S11, the CPU 2 judges whether a current set of eight-bit hue data represents a value from 0 to 63. If a positive judgement is made at Step S11, the control of the CPU 2 goes to Step S12 to determine that the picture element corresponding to the set of hue data belongs to a single-color area having a red color. If a negative judgment is made at Step S11, the control of the CPU 2 goes to Step S13 to judge whether the current set of eight-bit due data represents a value from 64 to 127. If a positive judgement is made at Step S13, the control goes to Step S14 to determine that the picture element corresponding to the set of hue data belongs to a single-color area having a blue color. If a negative judgment is made at Step S13, the control goes to Step S15 to judge the current set of eight-bit due data represents a value from 128 to 191. If a positive judgement is made at Step S15, the control goes to Step S16 to determine that the picture element corresponding to the set of hue data belongs to a single-color area having a yellow color. If a negative judgment is made at Step S15, that is, if the current set of eight-bit due data represents a value from 192 to 255, the control goes to Step S17 to determine that the picture element corresponding to the set of hue data belongs to a single-color area having a white color.

Thus, the color image A is divided into four single-color areas, i.e., (1) hill B, (2) house C, (3) cloud D, and (4) sky and window E, F. The CPU 2 further divides the area E, F into the sky E and window F, as follows: First, the first line of the picture elements of the image of the area E, F is scanned, and the first "effective" element having eight-bit hue data is labelled "A". Each effective element contiguous with the first effective element is also labelled "A". If a "non-effective" element having no hue data occurs and again an effective element occurs, the effective element is labelled "B". This operation is repeated so that the labels "A", "B", "C", . . . are given to the effective elements of the first line. With regard to the second and following lines, if one or both of two elements, $(i-1, j)$ and $(i, j-1)$, adjacent to an arbitrary effective element $(i, j)$ has or have a label, the element $(i, j)$ is given that label. If both of the two adjacent elements are non-effective elements, the element $(i, j)$ is given a new label. If the two adjacent elements have different labels, those elements are modified to have a common and single label. It is otherwise possible to scan four elements, $(i-1, j)$, $(i-1, j-1)$, $(i, j-1)$, and $(i+1, J-1)$, adjacent to an arbitrary effective element $(i, j)$, for dividing a single-color area into two or more separate portions isolated from each other. Regarding the area E, F of the color area A, the area E, F is given two different labels and therefore is divided into two separate portions, i.e., sky E and window F. The CPU 2 produces four sets of color-area data representing the four single-color areas and temporarily stores them in the RAM 4.

The color image A may include a single-color area (e.g., background area) which the operator does not wish to embroider. At Steps S3 and S4, the operator can specify, from the single-color areas, an embroidery-free area which is not to be embroidered. Specifically, at Step S3, the CPU 2 commands the LCDC 8 to display the respective images of the single-color areas on the screen *7a* of the LCD 7 based on the sets of color-area data stored in the RAM 4. Regarding the color image A, the four single-color areas are simultaneously displayed on the screen *7a* as shown in FIG. 6. The four single-color areas are separated into respective rectangles. At the following Step S4, while viewing the single-color areas displayed on the screen *7a*, the operator can operate the mouse 11 to specify, by the cursor on the screen *7a*, one of the single-color areas as an embroidery-free area (e.g., background area). Assuming that the operator selects the sky and window E, F as the embroidery-free area, the control of the CPU 2 goes to Step S5.

The specified embroidery-free area may however contain an embroidering portion which the operator wishes to embroider. Regarding the color image A, the sky E is just the background of the color image A and thus does not need embroidering, whereas the operator may wish to embroider the window F notwithstanding the window F is grouped with the sky E into the same single-color area for only the reason that the window F and sky E have the same color, i.e., white background color. The embroidery-free area may contain two or more embroidering portions.

Figure 7:
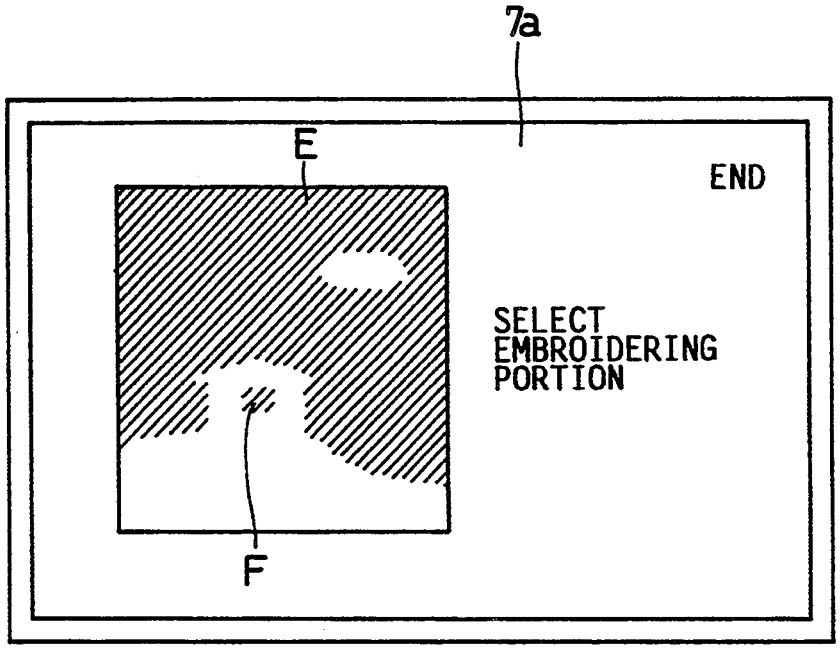
FIG. 7 is a view of the screen of the CRT display of the apparatus of FIG. 1, the screen displaying a color-different area selected as an embroidery-free area so that the operator or user can select one of separate portions of the embroidery-free area as an embroidering portion.

At Steps S5 and S6, the operator can specify, from the selected embroidery-free area, an embroidering portion which the person wishes to embroider. Specifically, at Step S5, the CPU 2 commands the LCDC 8 to display an enlarged image of the selected embroidery-free area on the screen *7a* of the LCD 7, as shown in FIG. 7. At Step S6, the operator operates the mouse 11 to specify, by the cursor on the screen *7a*, an embroidering portion from the embroidery-free area. It is assumed that the operator selects the window F as an embroidering portion.

Subsequently, at Step S7, the CPU 2 operates for producing embroidery data for the single-color areas except for the sky E, i.e., for the hill B, house C, cloud D, and window F. Specifically, the CPU 2 extracts the outline or outlines of each of the single-color areas, thereby producing a set of outline data representing the outline or outlines of each single-color area. Next, the CPU 2 divides each single-color area into a plurality of polygonal blocks such as quadrangles and/or triangles and the CPU 2 produces, as embroidery data, sets of block data representing the outlines of the polygonal blocks. Furthermore, based on the sets of block data, the CPU 2 produces, as embroidery data, stitch-position data to control the sewing machine 14 to form, on a work sheet, the embroidery A by sequentially filling each of the blocks of each single-color area with, e.g., satin or seed stitches formed with a corresponding color thread. At Step S8, the CPU 2 stores the embroidery data (block data or stitch-position data) in the flash memory 10. The flash memory 10 is removed from the embroidery data producing apparatus 1, and inserted into the data reading device 24 of the sewing machine 14. According to the embroidery data stored in the flash memory 10, the sewing machine 14 forms the embroider A in multiple colors using, e.g., four color-different threads.

It emerges from the foregoing description that, in the present embodiment, the image scanner 12 is operated to obtain as image data a chromatic color image A and the color image A is divided into a plurality of single-color areas having different colors. The apparatus 1 automatically produces a batch of embroider data for each of the single-color areas. Therefore, the operator's work necessary to produce embroidery data for forming a multiple-color embroidery, is largely reduced as compared with the conventional manner in which an original is divided into a plurality of secondary originals corresponding to respective single-color areas and a batch of embroidery data are prepared for each secondary original. Additionally, the present apparatus 1 enables the operator to specify one or more of the single-color areas, such as the background area, as one or more embroidery-free areas. The apparatus 1 does not produce embroidery data for the embroidery-free areas.

Furthermore, in the case where a selected embroidery-free area contains one or more embroidering portions which the operator wishes to embroider, the apparatus 1 enables the person to modify each embroidery-free area by specifying the embroidering portion or portions to be embroidered. That is, the operator can determine, on the apparatus 1, whether or not to embroider each of two or more separate portions which cooperate with each other to constitute a single-color area as an embroidery-free area. Thus, the present apparatus 1 is capable of producing embroidery data in a highly sophisticated manner.

Figure 8:
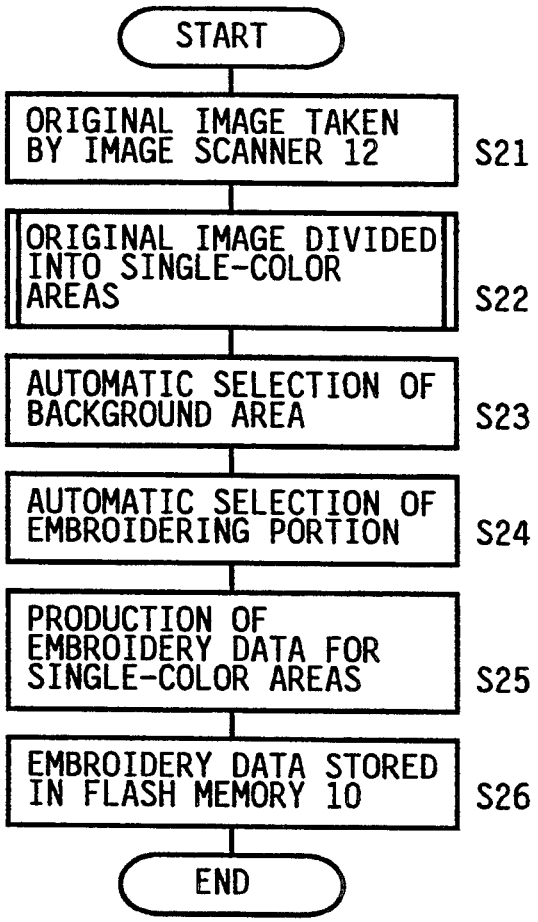
FIG. 8 is a flow chart corresponding to FIG. 3, representing another embroidery data production control program used by an embroidery data producing apparatus as a second embodiment of the invention.
Figure 9:
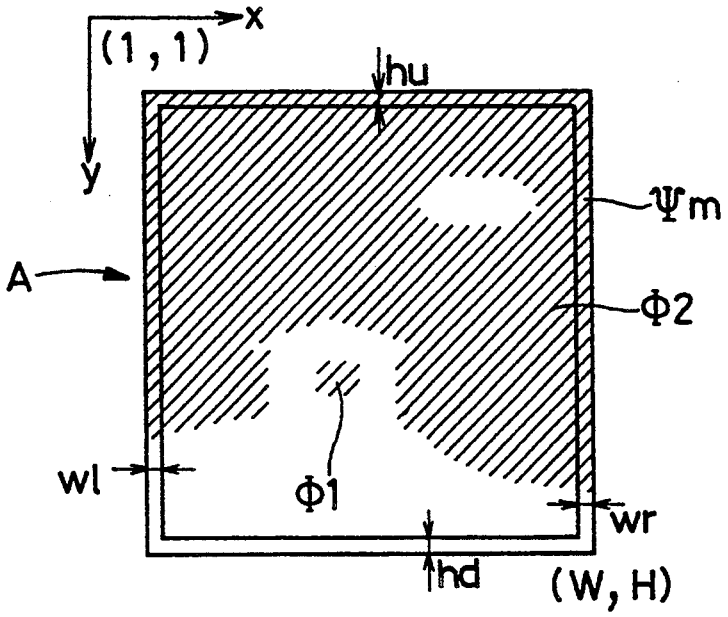
FIG. 9 is a view for explaining the manner of automatic identification of the background area of an original image carried out according to the flow chart of FIG. 8.

Next, there will be described the second embodiment of the present invention, by reference to FIGS. 8 and 9. The second embodiment also relates to an embroidery data producing apparatus and has the same hardware construction as that of the first embodiment shown in FIGS. 1 and 2. The second embodiment is different from the first embodiment in that the apparatus 1 in accordance with the second embodiment is operated according to the flow chart of FIG. 8. The flow chart of FIG. 8 is different from the flow chart of FIG. 3 in that Steps S23 and S24 of FIG. 8 are provided in place of Steps S3 through S6 of FIG. 3. Since the other steps, Steps S21, S22, S25, and S26, of FIG. 8 are the same as Steps S1, S2, S7, and S8 of FIG. 3, the description of those steps is omitted.

In the second embodiment, at Step S23, the CPU 2 operates for automatically identifying a background area from the single-color areas obtained at Step S22 and, at Step S24. the CPU 2 operates for automatically modifying the background area by identifying one or more embroidering portions from the single-color area identified as the background area, i.e., embroidery-free area not to be embroidered. The apparatus 1 produces embroidery data for an original color image such that the embroidery data do not include data for the background area but include data for the embroidering portion or portions identified from the background area.

At Step S23, the CPU 2 operates for identifying the background area of the original color image A in the following manner: First, the CPU 2 applies two-dimensional addresses (x, y; $1 \leqq x \leqq W$, $1 \leqq y \leqq H$) to the image (i.e., picture elements) of each of the single-color areas, as shown in FIG. 9. A predetermined peripheral area, $\Psi_m$, along the outline of the color image A is defined as follows:

$$\Psi_m = \{(x, y) \mid 1 \leqq x \leqq wl,\ W-wr+1 \leqq x \leqq W,\ 1 \leqq y \leqq hu,\ H-hd+1 \leqq y \leqq H\}$$

where wl, wr, hu, and hd are respective widths (i.e., predetermined numbers of picture-elements) of the left, right, top, and bottom portions of the peripheral area $\Psi_m$.

The CPU 2 operates for counting the number, $N_i$ ($i=1, 2, \ldots, n$), of "effective" picture elements of a portion of each single-color area, n, within the peripheral area $\Psi_m$. If the number $N_i$ satisfies the following expression (1), the single-color area n is identified as the background area of the color image A:

$$N_i / N(\Psi_m) > K \tag{1}$$

where $N(\Psi_m)$ is the total number of the picture elements of the peripheral area $\Psi_m$, and K is a reference value ($0.5 < K < 1$).

Alternatively, the apparatus 1 may be programmed to identify, as the background area of an original color image, a single-color area whose number $N_i$ is the greatest of all single-color areas of the color image. Regarding the color image A of FIG. 5, the single-color area including the sky E and window F is automatically identified as the background area of the color image A.

Step S23 is followed by Step S24 to identify, from the single-color area identified as the background area, one or more embroidering portions which should be embroidered. This is accomplished by first identifying one or more separate portions, $\Phi_i$ ($i=1, 2, \ldots, n$), isolated from each other in the single-color area in question. Regarding the single-color area of FIG. 9, two separate portions $\Phi_1$ and $\Phi_2$ are identified in a known process. If a separate portion $\Phi_i$ satisfies the following expression (2), the CPU 2 determines the separate portion Di as an embroidering portion which is to be embroidered.

$$\Psi_m \cap \Phi_i = \phi \tag{2}$$

Alternatively, the apparatus 1 may be programmed such that if a separate portion $\Phi_i$ satisfies the following two expressions (3), the CPU 2 determines the separate portion Di as an embroidering portion:

$$N(\Psi_m \cap \Phi_i) < P, \text{ and, } N(\Phi_i) < Q \tag{3}$$

where $N(\Psi_m \cap \Phi_i)$ is the total number of the picture elements of a portion of the separate portion $\Phi_i$ within the peripheral area $\Psi_m$, $N(\Phi_i)$ is the total number of the picture elements of the separate portion $\Psi_m$, and P and Q are reference values, respectively.

Regarding the color image A of FIG. 5, the window F ($\Phi_1$) is identified as an embroidering portion. Otherwise, the apparatus 1 may be programmed such that the CPU 2 determines a separate portion $\Phi_i$ as an embroidering portion if the portion $\Phi_i$ satisfies either one of the two expressions (3).

As is apparent from the foregoing description, like the first embodiment, the apparatus 1 in accordance with the second embodiment is capable of easily producing embroidery data for forming a multiple-color embroidery, without producing data for an embroidery-free area, such as a background area of an original color image, which does not need embroidering. Since the apparatus 1 is capable of automatically identifying the background area of an original color image, the operator's work necessary for producing the embroidery data is minimized. Furthermore, the apparatus 1 is capable of automatically identifying an embroidering portion from the single-color area identified as the background area. Thus, the present apparatus 1 is capable of easily producing excellent embroidery data for forming an elaborate multiple-color embroidery.

While the present invention has been described in its preferred embodiments, the present invention may otherwise be embodied.

For example, although in the first and second embodiments an embroidery-free area or a background area is modified at Steps S5 and S6, or at Step S24, it is possible to omit those steps. In the first embodiment, Steps S5 and S6 may be replaced by Step S24 for the second embodiment. Likewise, in the second embodiment, Step S24 may be replaced by Steps S5 and S6 for the first embodiment.

In the first and second embodiments, the color image scanner 12 may be replaced by a black-and-white image scanner to obtain black-and-white image data from an achromatic color image. In this case, the apparatus 1 may be programmed to divide the color image into, e.g., black, gray, and white areas by utilizing the differences of brightness of the individual picture elements of the color image. As far as the present invention is concerned, a color image is defined as comprising both a chromatic color image and an achromatic color image.

While in the illustrated embodiments the apparatus 1 is programmed to divide a color image into four color areas having different colors, it is possible to program the apparatus 1 to divide a color image into two, three, five, or more color areas having different colors.

The apparatus 1 of FIG. 1 may essentially be constituted by a widely used personal computer, and the image scanner 12 may be replaced by a different image pick-up device. In place of the image scanner 12 employed for obtaining image data representing a color image, it is possible to utilize image data pre-stored in an external memory such as a flash memory.

It is to be understood that the present invention may be embodied with other changes, improvements, and modifications that may occur to those skilled in the art without departing from the spirit and scope of the invention defined in the pending claims.

What is claimed is:

1. An apparatus for producing embroidery data to control a sewing machine to form an embroidery on a work sheet, the apparatus comprising:

dividing means for dividing, based on image data representing a color image, said color image into a plurality of color areas each of which has a corresponding one of a plurality of different colors, and producing a plurality of sets of color-area data each of which represents a corresponding one of said color areas;

a color-area specifying device which is operable by an operator for specifying one of said color areas as an embroidery-free area; and producing means for producing, based on said sets of color-area data, said embroidery data to control the sewing machine to embroider said color areas except for said embroidery-free area specified by said specifying device.

2. An apparatus according to claim 1, wherein said dividing means comprises means for dividing a chromatic image as said color image, into said color areas having different chromatic colors, respectively.

3. An apparatus according to claim 1, wherein said dividing means comprises means for dividing an achromatic image as said color image, into said color areas having different achromatic colors, respectively.

4. An apparatus according to claim 1, wherein said dividing means divides said color image into at least three said color areas having at least three said different colors, respectively.

5. An apparatus according to claim 1, further comprising a memory which stores said image data comprising a number of sets of picture-element data each set of which represents a color characteristic of a corresponding one of a number of picture elements of said color image.

6. An apparatus according to claim 1, further comprising an image pick-up device which picks up said color image from an original and produces said image data representing the color image.

7. An apparatus according to claim 6, wherein said image pick-up device comprises image-data producing means for producing, as said image data, a number of sets of picture-element data each set of which represents a hue of a corresponding one of a number of picture elements of said color image.

8. An apparatus according to claim 7, wherein said image-data producing means produces, as said each set of picture-element data, a set of bit data representing a value corresponding to said hue of said corresponding one picture element, said dividing means dividing said color image into said color areas having said different colors, based on the sets of bit data representing the values corresponding to the respective hues of the picture elements of the color image.

9. An apparatus according to claim 6, wherein said image pick-up device comprises means for producing, as said image data, a number of sets of picture-element data each set of which represents a brightness of a corresponding one of a number of picture elements of said color image.

10. An apparatus according to claim 1, wherein said color-area specifying device comprises a color display which displays said color areas such that said each of said color areas has said corresponding one of said different colors.

11. An apparatus according to claim 10, wherein said color-area specifying device further comprises:

a cursor movable on said color display; and a manually operable member for moving said cursor to specify said embroidery-free area on said color display.

12. An apparatus according to claim 1, further comprising a modifying device which modifies said embroidery-free area specified by said color-area specifying device.

13. An apparatus according to claim 12, wherein said modifying device comprises:

means for dividing said embroidery-free area into a plurality of separate portions isolated from each other; and an embroidering-portion specifying device which is operable by an operator for specifying one of said separate portions as an embroidering portion, said producing means producing said embroidery data including data for said embroidering portion.

14. An apparatus according to claim 1, wherein said producing means comprises means for producing, as said embroidery data, at least one of (a) a number of sets of stitch-position data representing stitch positions on an outline of each of said color areas where a sewing needle of the sewing machine penetrates said work sheet and (b) a plurality of sets of block data each of which represents an outline of a corresponding one of a plurality of polygonal blocks which cooperate with each other to define said color areas.

15. An apparatus according to claim 1, further comprising a utilizing device which utilizes said embroidery data produced by said producing means to control the sewing machine to form said embroidery on said work sheet.

16. An apparatus according to claim 15, wherein said utilizing device comprises a stitch-forming device of the sewing machine which embroiders said color areas and thereby provides said embroidery on said work sheet according to said embroidery data.

17. An apparatus according to claim 15, wherein said utilizing device comprises a recording device which records, in an external memory, said embroidery data to control the sewing machine to form said embroidery on said work sheet.

18. An apparatus according to claim 17, wherein said recording device records said embroidery data in a flash-memory card as said external memory.

19. An apparatus for producing embroidery data to control a sewing machine to form an embroidery on a work sheet, the apparatus comprising:

dividing means for dividing, based on image data representing a color image, said color image into a plurality of color areas each of which has a corresponding one of a plurality of different colors, and producing a plurality of sets of color-area data each of which represents a corresponding one of said color areas;

identifying means for identifying one of said color areas as an embroidery-free area; and producing means for producing, based on said sets of color-area data, said embroidery data to control the sewing machine to embroider said color areas except for said embroidery-free area identified by said identifying means.

20. An apparatus according to claim 19, wherein said image data comprise a number of sets of picture-element data each set of which represents a color characteristic of a corresponding one of a number of picture elements of said color image, said dividing means dividing, based on said sets of picture-element data, said color image into said color areas having said different colors.

21. An apparatus according to claim 20, wherein said identifying means comprises:

first means for determining a number of the sets of picture-element data corresponding to the picture elements of a portion of each of said color areas within a predetermined peripheral area along an outline of said color image; and second means for identifying one of said color areas as said embroidery-free area based on the data-set number determined for said each of said color areas.

22. An apparatus according to claim 21, wherein said second means identifies as said embroidery-free area one of said color areas when a ratio of the data-set number determined therefor to a number of the sets of picture-element data corresponding to all the picture elements of said predetermined peripheral area is greater than a reference value.

23. An apparatus according to claim 22, wherein said reference value is greater than 0.5.

24. An apparatus according to claim 21, wherein said second means identifies as said embroidery-free area one of said color areas when the data-set number determined therefor is greatest of all said color areas.

25. An apparatus according to claim 20, further comprising a modifying device which modifies said embroidery-free area identified by said identifying means.

26. An apparatus according to claim 25, wherein said modifying device comprises:

means for dividing said embroidery-free area into a plurality of separate portions isolated from each other; and embroidering-portion identifying means for identifying one of said separate portions as an embroidering portion, said producing means producing said embroidery data including data for said embroidering portion.

27. An apparatus according to claim 26, wherein said embroidering-portion identifying means comprises means for identifying as said embroidering portion one of said separate portions which has no picture element within a predetermined peripheral area along an outline of said color image.

28. An apparatus according to claim 26, wherein said embroidering-portion identifying means comprises:

means for determining at least one of (a) a first number of the sets of picture-element data corresponding to the picture elements of a portion of each of said color areas within a predetermined peripheral area along an outline of said color image, and (b) a second number of the sets of picture-element data corresponding to all the picture elements of each of said color areas; and means for identifying as said embroidering portion one of said separate portions which satisfies at least one of (a) a first condition that the first number determined therefor is smaller than a first reference value and (b) a second condition that the second number determined therefor is smaller than a second reference value.

29. An apparatus according to claim 19, further comprising a utilizing device which utilizes said embroidery data produced by said producing means to control the sewing machine to form said embroidery on said work sheet.

30. An apparatus according to claim 29, wherein said utilizing device comprises a stitch-forming device of the sewing machine which embroiders said color areas and thereby provides said embroidery on said work sheet according to said embroidery data.

31. An apparatus according to claim 29, wherein said utilizing device comprises a recording device which records, in an external memory, said embroidery data to control the sewing machine to form said embroidery on said work sheet.

32. An apparatus according to claim 31, wherein said recording device records said embroidery data in a flash-memory card as said external memory.

33. An apparatus according to claim 19, further comprising an image pick-up device which picks up said color image from an original and produces said image data representing the color image.

34. An apparatus for producing embroidery data to control a sewing machine to form an embroidery on a work sheet, the apparatus comprising:

dividing means for dividing, based on image data representing a color image, said color image into a plurality of color areas each of which has a corresponding one of a plurality of different colors, and producing a plurality of sets of color-area data each of which represents a corresponding one of said color areas;

background-area identifying means for identifying one of said color areas as a background area of said color image; and producing means for producing, based on said sets of color-area data, said embroidery data to control the sewing machine to embroider said color areas except for said background area identified by said identifying means.

35. A process of producing embroidery data to control a sewing machine to form an embroidery on a work sheet, the process comprising the steps of:

dividing, based on image data representing a color image, said color image into a plurality of color areas each of which has a corresponding one of a plurality of different colors, and producing a plurality of sets of color-area data each of which represents a corresponding one of said color areas;

specifying one of said color areas as an embroidery-free area by operating a color-area specifying device; and producing, based on said sets of color-area data, said embroidery data to control the sewing machine to embroider said color areas except for said embroidery-free area.

36. A process according to claim 35, further comprising a step of storing, in a memory, said image data comprising a number of sets of picture-element data each set of which represents a color characteristic of a corresponding one of a number of picture elements of said color image.

37. A process according to claim 35, further comprising a step of picking up, by operating an image pick-up device, said color image from an original and producing said image data representing the color image.

38. A process according to claim 35, further comprising a step of modifying said embroidery-free area specified by operating said color-area specifying device.

39. A process according to claim 38, wherein the step of modifying said embroidery-free area comprises:

dividing, based on the set of color-area data for said embroidery-free area, said embroidery-free area into a plurality of separate portions isolated from each other; and specifying, by operating an embroidering-portion specifying device, one of said separate portions as an embroidering portion, the step of producing said embroidery data comprising producing said embroidery data including data for said embroidering portion.

40. A process according to claim 35, further comprising a step of utilizing said embroidery data to control the sewing machine to form said embroidery on said work sheet.

41. A process of producing embroidery data to control a sewing machine to form an embroidery on a work sheet, the process comprising the steps of:

dividing, based on image data representing a color image, said color image into a plurality of color areas each of which has a corresponding one of a plurality of different colors, and producing a plurality of sets of color-area data each of which represents a corresponding one of said color areas;

identifying one of said color areas as an embroidery-free area; and producing, based on said sets of color-area data, said embroidery data to control the sewing machine to embroider said color areas except for said embroidery-free area.

42. A process according to claim 41, further comprising a step of storing, in a memory, said image data comprising a number of sets of picture-element data each set of which represents a color characteristic of a corresponding one of a number of picture elements of said color image.

43. A process according to claim 42, wherein the step of identifying said embroidery-free area comprises:

determining a number of the sets of picture-element data corresponding to the picture elements of a portion of each of said color areas within a predetermined peripheral area along an outline of said color image; and identifying one of said color areas as said embroidery-free area based on the data-set number determined for said each of said color areas.

44. A process according to claim 41, further comprising a step of modifying said embroidery-free area.

45. A process according to claim 44, wherein the step of modifying said embroidery-free area comprises:

dividing said embroidery-free area into a plurality of separate portions isolated from each other; and identifying one of said separate portions as an embroidering portion, the step of producing said embroidery data comprising producing said embroidery data including data for said embroidering portion.

46. A process according to claim 41, further comprising a step of utilizing said embroidery data to control the sewing machine to form said embroidery on said work sheet.

* * * * *